United States Patent [19]

Tauzin

[11] 4,338,863

[45] Jul. 13, 1982

[54] PNEUMATIC SUSPENSION SYSTEM FOR ROPEWAY CARS

[75] Inventor: Francis Tauzin, Veyrins, France

[73] Assignees: Pomagalski S.A.; Sigma Plastique, both of France

[21] Appl. No.: 144,816

[22] Filed: Apr. 29, 1980

[51] Int. Cl.[3] ..... B61B 3/00

[52] U.S. Cl. ..... 104/89; 104/112; 104/115; 105/150

[58] Field of Search ..... 104/154, 155, 89–95, 104/112, 115; 105/150, 153, 148, 151

[56] References Cited

U.S. PATENT DOCUMENTS 3,915,093 10/1975 Barthalon et al. ..... 105/149

*Primary Examiner*—Richard A. Bertsch

*Attorney, Agent, or Firm*—William A. Drucker

[57] ABSTRACT

This suspension device for the car of a ropeway comprises a pneumatic balloon tire interposed between the bottom of a carrying strap suspended from the wire rope of the ropeway and an upper frame of the car framework which bears upon the tire.

4 Claims, 7 Drawing Figures

PNEUMATIC SUSPENSION SYSTEM FOR ROPEWAY CARS

BACKGROUND OF THE INVENTION

This invention relates to ropeways or cableways in general and has specific reference to gondolas or cars for use on aerial ropeways, notably for transporting four or six passengers, and it is the primary object of this invention to provide a particularly simple pneumatic suspension system for gondolas used on such aerial lines, more particularly an efficient pneumatic suspension system which can readily be disassembled when necessary.

The suspension system according to this invention is characterized essentially in that a pneumatic balloon tire, comparable with a light-aircraft landing wheel tire, is inserted in a substantially horizontal position into the space available between the base of a suspension strap supporting said tire and an upper car frame rigid with the carrier framework of the car and bearing substantially horizontally on the tire.

By inflating the tire to a pressure corresponding approximatively to the vibration frequency of the carrying rope, it is possible to absorb vibration, avoid detrimental resonance effects, improve the passenger's comfort and reduce noise.

The suspension strap may have a substantially U-like configuration, with a substantially horizontal tire-supporting bottom and substantially vertical front and rear wings or flanges extending upwardly through the upper frame of the car for suspending the latter from a substantially vertical hanger of which the upper end may comprise a clamp for gripping a carrier and drive rope, in the case of a monocable ropeway.

The strap wings are advantageously rigid with longitudinal arms connected to the front and rear ends of the upper frame of the car by means of shock-absorbers, preferably of the simplest and well-known type, such as engine vibration insulators widely used for mounting automobile engines, so as to damp out rolling and pitch oscillation likely to start and develop unduly as a consequence of wind pressure.

DESCRIPTION OF THE PREFERRED EMBODIMENT

Figure 1:
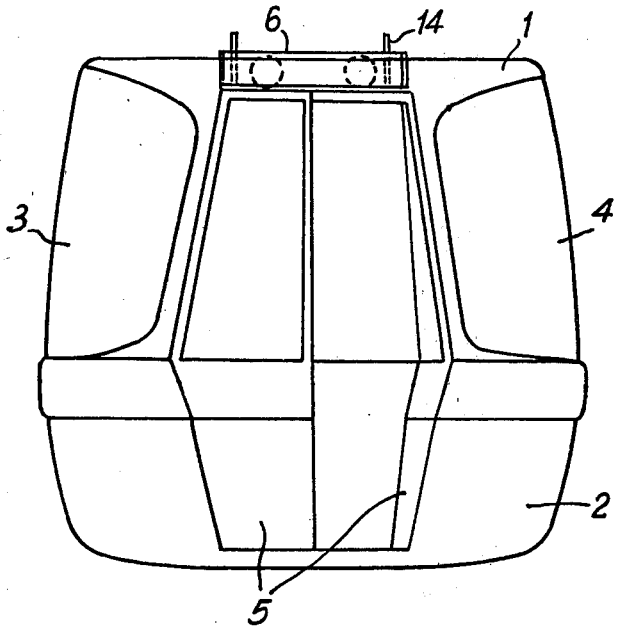
FIG. 1 is a simplified general side elevational view of an aerial ropeway car or gondola to which the present invention is applicable.
Figure 2:
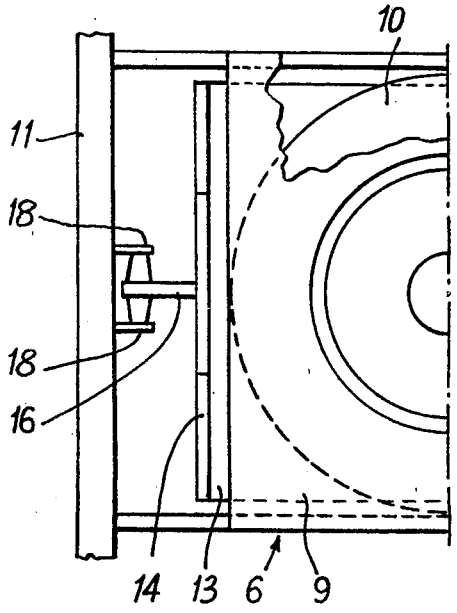
FIG. 2 is a half plan view from above showing the top of the car equipped with the pneumatic suspension system of this invention.
Figure 3:
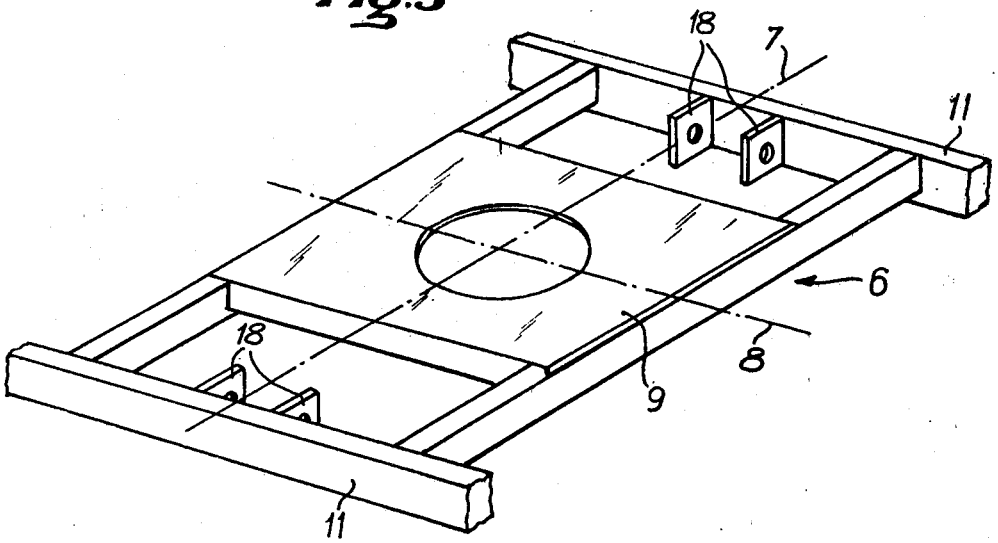
FIG. 3 is a perspective schematic view showing the top frame of the car.
Figure 4:
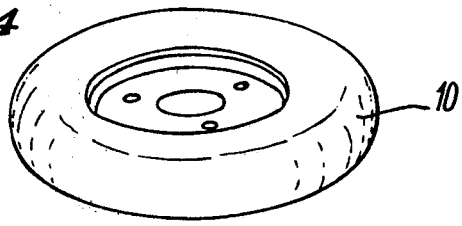
FIG. 4 is a perspective view of the tire used for supporting the central portion of this frame.

The specific constitution of the ropeway gondola or car, shown only in a simplified diagrammatic manner in FIG. 1, is not included in the present invention and the drawing shows only by way of example that its upper portion 1, fitted on top of the lower portion 2, comprises two transparent opposed front and rear walls or windows 3, 4, respectively, and that this gondola has a lateral door consisting of a pair of hinged leaves 5.

The car body comprises essentially a metal carrier framework and a revetment consisting for example in the known fashion of molded plastic panels.

The top of the upper portion of the metal framework consists of a top car frame 6 incorporating means for automatically controlling the door leaves, according to a well-known arrangement (not shown).

According to this invention, the upper car frame 6 comprises a pneumatic suspension system consituting the essential object of the present invention, a typical form of embodiment thereof being described hereinafter with reference more particularly to FIGS. 2 to 5 of the drawing.

Figure 5:
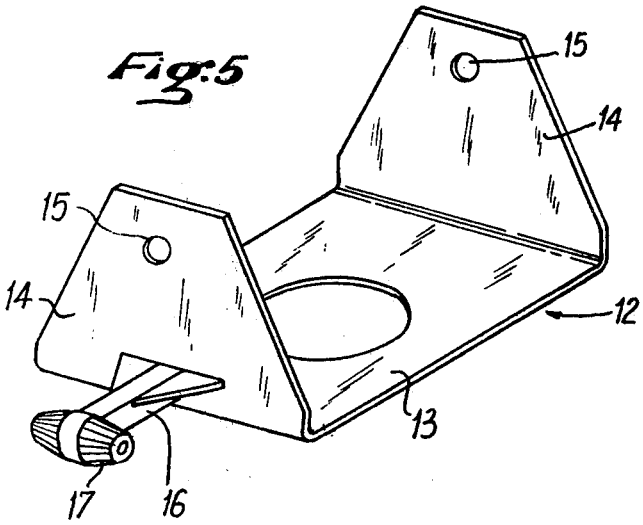
FIG. 5 is a perspective view of the strap supporting the car frame with the interposition of the tire of FIG. 4.

The upper car frame, designated in general by the reference numeral 6, is an integral part of the carrier metal framework of the ropeway car and may have a substantially rectangular horizontal configuration, with a longitudinal center line 7 and a transverse center line 8. This frame 6 comprises a solid central portion 9 constituting a platform adapted to bear upon a pneumatic tire 10 and two front and rear end portions apertured between the central portion 9 and two opposed end cross members 11 to permit the passage of the corresponding vertical wings or flanges of the suspension strap 12 (FIG. 5). This strap is of substantially U-shaped configuration with a horizontal bottom 13 adapted to carry the tire 10 and with vertical end wings 14 extending upwardly through the aforesaid apertured end portions of frame 6 so that the strap can be suspended by means of holes 15 formed through the upper portions of said wings engaged by a longitudinal shaft rigidly connected to the hanger (not shown) extending downwardly from the carrier and drive wire rope of the ropeway.

Each wing 14 of strap 12 is rigid with an outwardly extending longitudinal link 16 supporting at its outer end a vibration insulator in the form of rubber pads or cushions 17 adapted to be secured by means of a horizontal transverse spindle or bolt to lugs 18 projecting from the inner face of the relevant end cross member 11 of the upper car frame 6.

Figure 6:
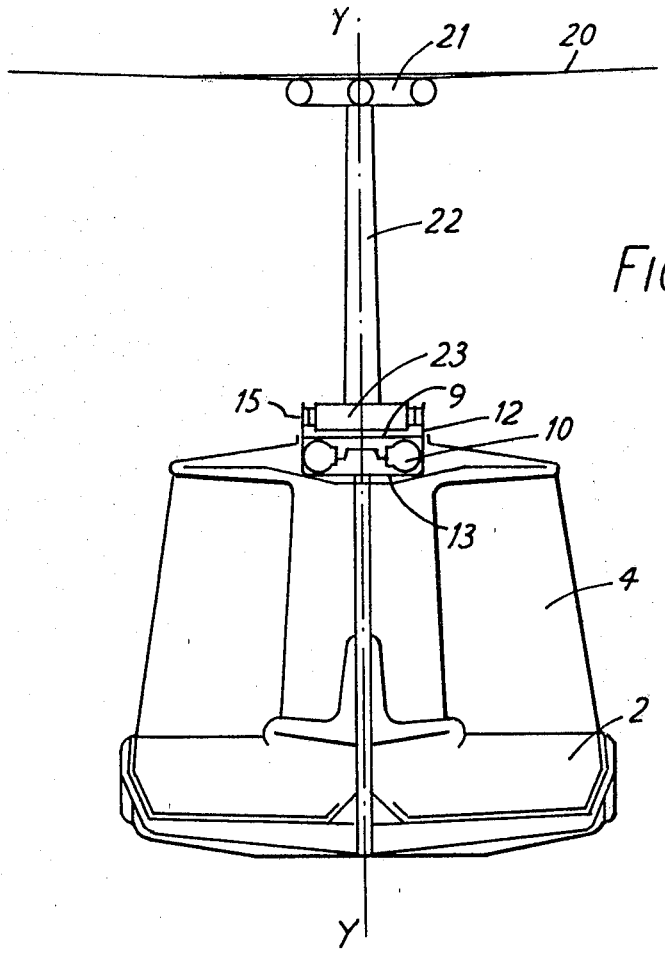
FIG. 6 is a schematic sectional elevation taken on the line X—X of FIG. 7, to show cooperation between the ropeway, the vehicle and the suspension system.
Figure 7:
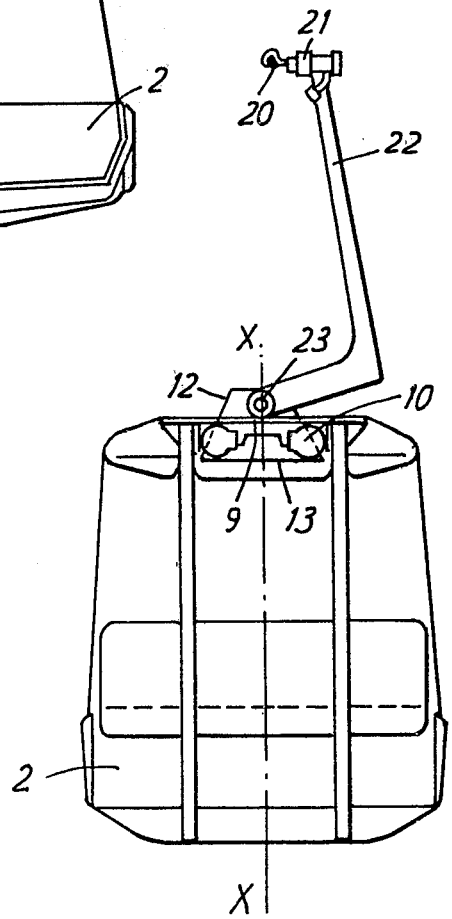
FIG. 7 is a schematic sectional elevation, taken on the line Y—Y of FIG. 6.

Referring to FIGS. 6 and 7, a cable 20 carries an attaching member 21 from which depends a hanger 22 coupled to the end wings 14 by a longitudinal shaft 23.

It is clear that the desired flexibility of the suspension system is provided by the pneumatic balloon tire 10, and that the rolling and pitch oscillations are damped out by the pair of vibration isolators 17. This suspension system is both very efficient and simple in construction, and requires little or no maintenance. Furthermore, it can easily be disassembled since it is only necessary to disconnect the car hanger from the wings 14 of strap 12, and the vibration isolators 17 from the lugs 18 of the end cross members 11 of the upper car frame 6.

It will readily occur to those conversant with the art that the preferred form of embodiment described hereinabove with reference to the schematic drawing attached hereto should not be construed as limiting the scope of the invention, since various constructional modifications and changes could be brought thereto without departing from the basic principles of the invention as recited in the appended claims. More particularly, in the foregoing it is assumed that the wings 14 of strap 12 are located at the front and rear ends of the strap, but it is evident that they could as well be disposed laterally together with the corresponding apertures formed in the upper frame 6 of the car structure, the longitudinal axis 7 being in this case disposed transversely with respect to the car, the axis 8 becoming the longitudinal center line of the frame.

What I claim is:

1. In a ropeway car of the type comprising a metal carrier framework suspended from a wire rope of the ropeway and a revetment carried by said framework, a pneumatic suspension system which comprises:

(i) a top frame structure rigid with said car framework and including a platform, (ii) a carrying strap suspended from the wire rope of the ropeway, and including a bottom portion, (iii) a balloon tire interposed between the platform of the top frame structure and the bottom of said carrying strap, whereby said top frame is carried by said tire and is resiliently restrained against any movement relative to said carrying strap.

2. A pneumatic suspension system, as claimed in claim 1, comprising a pair of opposed links rigid with said carrying strap, each said link having a free end provided with a vibration insulator connected to said framework for damping out rolling and pitch oscillations of the car relative to the carrying strap.

3. In a ropeway car of the type comprising a metal carrier framework suspended from a wire rope of the ropeway and a revetment carried by said framework, a pneumatic suspension system which comprises:

(i) a top frame structure, rigid with said car framework, having apertured end portions, (ii) a carrying strap suspended from the wire rope of the ropeway, said carrying strap having a substantially U-shaped configuration with a horizontal bottom and with vertical wings extending upwardly towards a hanger through said apertured end portions of said top frame structure, (iii) a balloon tire interposed between the bottom of said carrying strap and said frame, whereby said frame is caused to rest upon said tire.

4. A pneumatic system, as claimed in claim 3, wherein said carrying strap is rigid with a pair of opposed links having their free ends each provided with a vibration insulator connected to the top frame structure of the car for damping out rolling and pitch oscillations of the car.

* * * * *